US007147589B2

(12) United States Patent
Chae

(10) Patent No.: US 7,147,589 B2
(45) Date of Patent: Dec. 12, 2006

(54) TWIST MACHINE FOR WHOLE BODY EXERCISE

(76) Inventor: Hee-Seon Chae, Shindonga Apt., 26-1106, Banghak-3-dong, Dobong-gu, Seoul, 132-762 (KR)

( * ) Notice: Subject to any disclaimer, the term of this patent is extended or adjusted under 35 U.S.C. 154(b) by 0 days.

(21) Appl. No.: 10/551,719

(22) PCT Filed: Mar. 26, 2004

(86) PCT No.: PCT/KR2004/000696

§ 371 (c)(1),
(2), (4) Date: Oct. 3, 2005

(87) PCT Pub. No.: WO2004/087263

PCT Pub. Date: Oct. 14, 2004

(65) Prior Publication Data

US 2006/0183604 A1 Aug. 17, 2006

(30) Foreign Application Priority Data

Apr. 3, 2003 (KR) ..... 20-2003-0010175
Jul. 11, 2003 (KR) ..... 10-2003-0047252

(51) Int. Cl.
*A63B 22/00* (2006.01)
*A63B 22/14* (2006.01)

(52) U.S. Cl. ..... 482/51; 482/146

(58) Field of Classification Search ..... 482/51–53, 482/62, 70, 73, 79, 95, 96, 131, 136, 142, 482/146, 147; D21/688, 689
See application file for complete search history.

(56) References Cited

U.S. PATENT DOCUMENTS 5,433,690 A * 7/1995 Gilman ..... 482/146
5,599,262 A * 2/1997 Shih ..... 482/147
5,967,610 A * 10/1999 Lin ..... 297/340
6,149,552 A * 11/2000 Chen ..... 482/72
6,273,841 B1 * 8/2001 Johnston ..... 482/51
6,875,159 B1 * 4/2005 Chuang ..... 482/51
6,899,657 B1 * 5/2005 Chuang ..... 482/52
6,918,861 B1 * 7/2005 Liao et al. ..... 482/57

* cited by examiner

*Primary Examiner*—Jerome Donnelly
*Assistant Examiner*—Tam Nguyen
(74) *Attorney, Agent, or Firm*—Mayer, Brown, Rowe & Maw LLP

(57) ABSTRACT

A twist machine for whole body exercise comprises a base (10), a rotary post (20) rotatably mounted on the base, a seat (30) provided on the top of the rotary post, a handle (60) operatively associated with the rotary post for rotation about the rotary post, and a reverse rotator (50, 70, 72) for causing the rotary post and the handle to turn in an opposite direction with each other when one of the rotary post and the handle is subjected to forcible rotation. The reverse rotator is provided with a sun gear (70) affixed to the rotary post, a plurality of planetary gears (72) rotatably mounted to the base in a meshing engagement with the sun gear and a ring gear (50) fixedly secured to the handle in a meshing engagement with the planetary gears.

4 Claims, 5 Drawing Sheets

TWIST MACHINE FOR WHOLE BODY EXERCISE

CROSS REFERENCE TO RELATED APPLICATION

This application is the National Phase application of International Application No. PCT/KR2004/000696, filed Mar. 26, 2004, which designates the United States and was published in English. This application, in its entirety, is incorporated herein by reference.

FIELD OF THE INVENTION

The present invention relates to sports equipment, and more particularly, relates to a twist machine for whole body exercise capable of enabling every parts of a human body to be exercised evenly.

BACKGROUND OF THE INVENTION

As many people recognize the importance of health, various types of health equipments have been developed for the purpose of promoting health, managing obesity, and maintaining a body shape. Especially, a variety of indoor sports equipments have been recently put into use such that people can exercise in a relatively small space such as a room.

The indoor exercise equipments includes, for example, a treadmill, a health bike, a cyclone, a step machine, a bench press, and a carp's motion machine. These exercise equipments make it possible for the users to do an aerobic exercise, a waist exercise, an arm exercise, a leg exercise, a breast exercise, etc. even in a small compartment, thereby assuring that the moderns who suffer from an absolute lack of exercise can enjoy exercise regardless of time and place.

Although the known exercise equipments can be advantageously used without regard to time and place, they has a disadvantage of reduced exercise effect because a specific part of a human body is intensively exercised, and not the whole body. Such intensive exercise may lead to over-exercise with attendant unfavorable side effects.

Specifically, the treadmill, which is known to have an advantage of strengthening the cardiac and pulmonary function of a user, may cause damage of knee or ankle joint, especially when old people or over-weighted persons continue to use the treadmill for a prolonged period of time.

In addition, the exercise equipments such as the health bike, the cyclone, the step machine and the bench press are dedicated to concentrated exercise of local bodily parts such as legs, arms, and a breast of the users, meaning that this kind of exercise equipments can hardly be used for the whole body exercise. Especially, the exercise equipments such as the health bike and the bench press are adapted to strengthen the muscular power of a human body through a so-called non-aerobic exercise. For that reason, this type of exercise equipments cannot be a help to the over-weighted people who have to do an aerobic exercise for reduction of bodily fat.

SUMMARY OF THE INVENTION

It is, therefore, an object of the present invention to provide a twist machine for whole body exercise capable of enabling every parts of a human body to be exercised evenly and synthetically.

It is another object of the present invention to provide a twist machine for whole body exercise that allows the bodily parts to be exercised coincidently and effectively, while minimizing unfavorable side effects to the human body that may otherwise be caused due to an excessive exercise.

It is a further object of the present invention to provide a twist machine for whole body exercise capable of strengthening the muscular power of a human body and reducing the bodily weight through non-aerobic and aerobic exercise.

In accordance with the present invention, there is provided a twist machine for whole body exercise comprising a base, a rotary post rotatably mounted on the base, a seat provided on the top of the rotary post, a handle operatively associated with the rotary post for rotation about the rotary post, and a reverse rotator for causing the rotary post and the handle to turn in an opposite direction with each other when one of the rotary post and the handle is subjected to forcible rotation.

The reverse rotator is, preferably, provided with a sun gear affixed to the rotary post, a plurality of planetary gears rotatably mounted to the base in a meshing engagement with the sun gear, and a ring gear fixedly secured to the handle in a meshing engagement with the planetary gears.

BEST MODE FOR CARRYING OUT THE INVENTION

A preferred embodiment of the inventive twist machine for whole body exercise will be described in detail hereinbelow in conjunction with the accompanying drawings.

Figure 1:
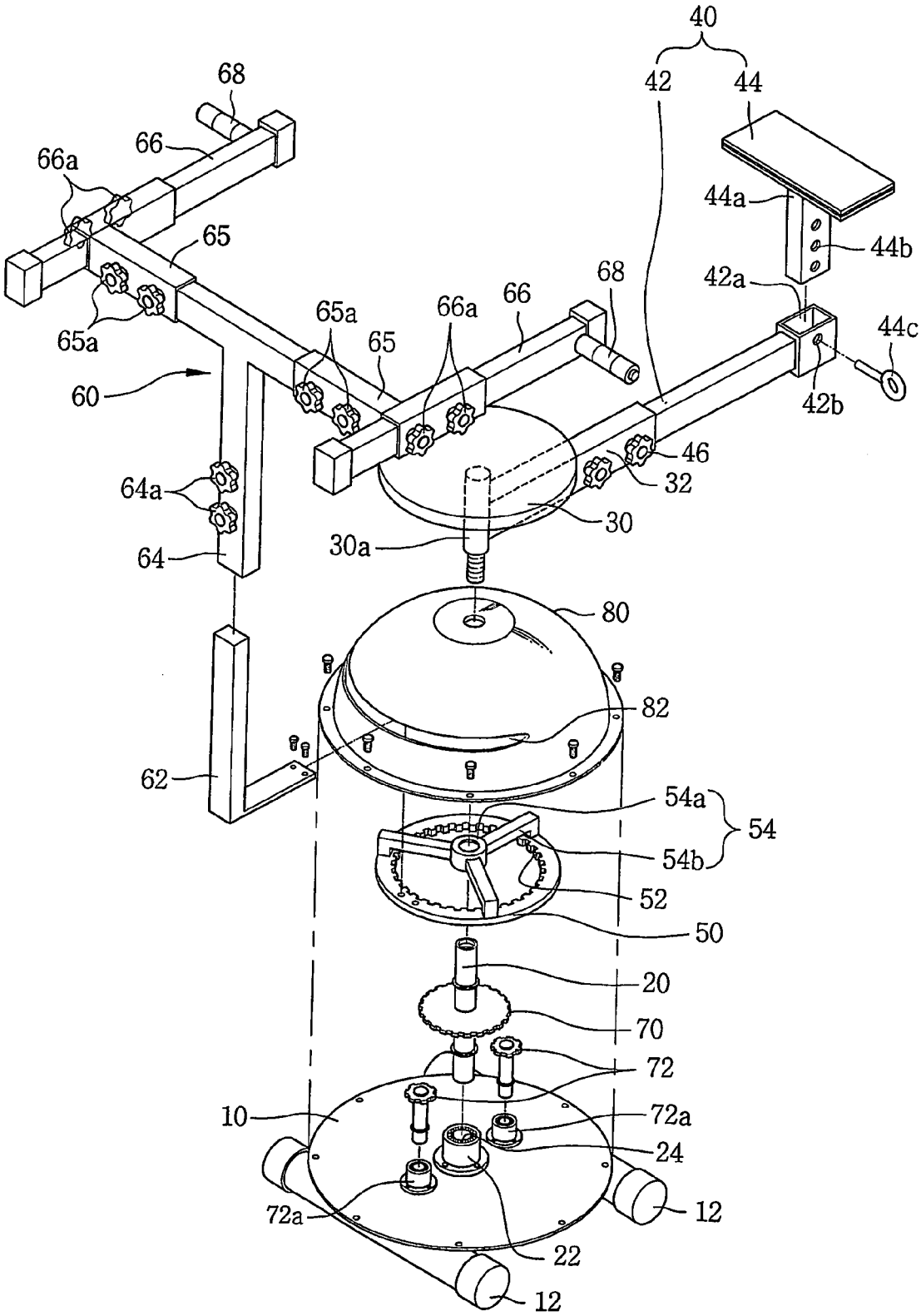
FIG. 1 is an exploded perspective view illustrating a twist machine for whole body exercise in accordance with the present invention.
Figure 2:
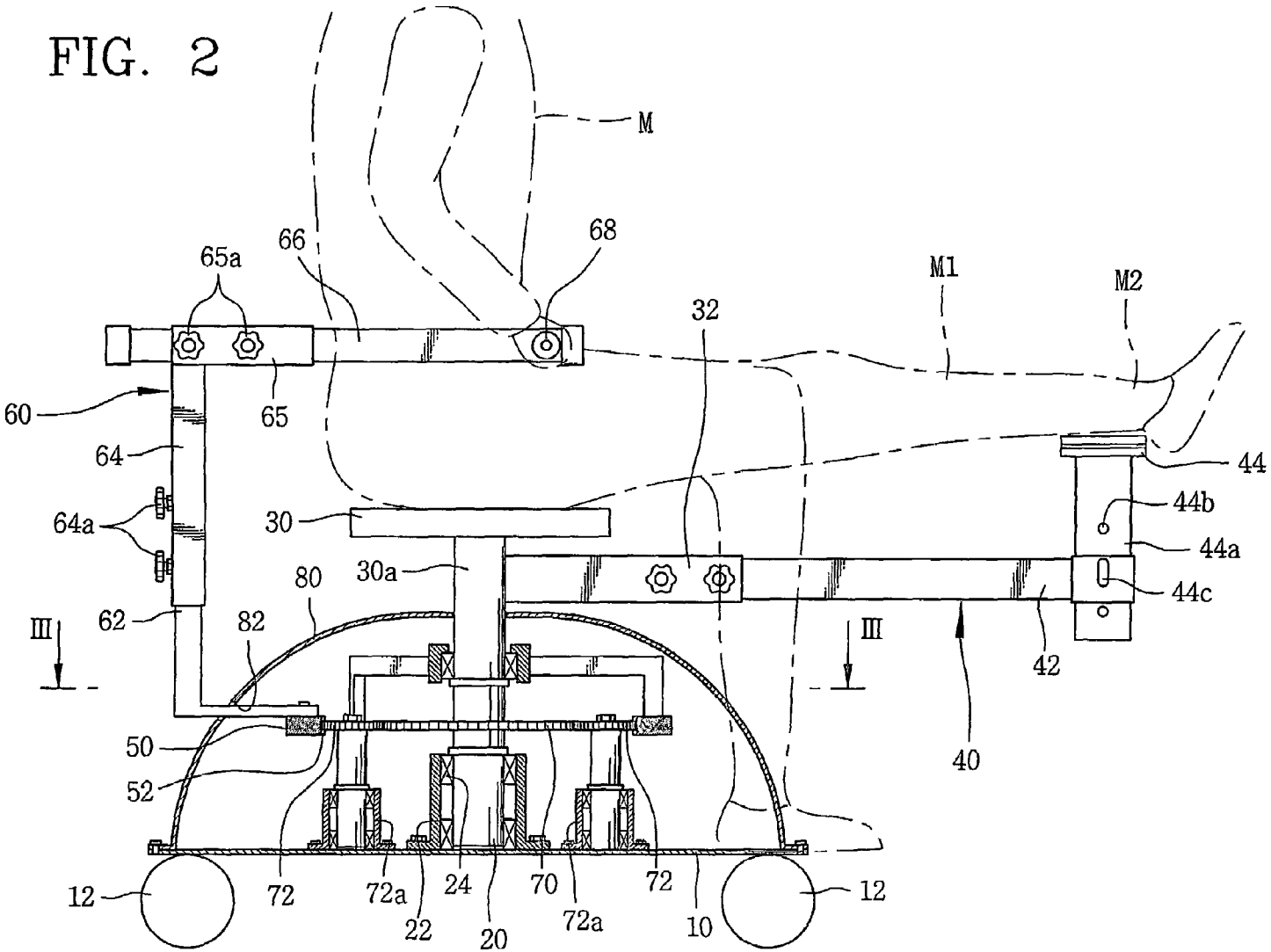
FIG. 2 is a side cross-sectional view showing the twist machine for whole body exercise in accordance with the present invention, with parts thereof assembled together.

First, as shown in FIGS. 1 and 2, a twist machine of the present invention is provided with a base 10. The base 10 has a shape of circular plate with a predetermined thickness and serves to support remaining parts of the twist machine. The base 10 is provided with a pair of spaced-apart stabilizer beams 12 secured to its bottom surface. The pair of spaced-apart stabilizer beams 12 makes sure that the base 10 be stably supported on the ground. Furthermore, the stabilizer beams 12 provide a stool on which the legs M1 of a user M may be placed.

In addition, the twist machine of the present invention is provided with a rotary post 20 mounted on the base 10 for rotation about a vertical axis thereof, and a seat 30 fixedly attached to the top of the rotary post 20.

The rotary post 20 is inserted into a bearing stand 22 installed on the top surface of the base 10 and can be caused to rotate about a vertical axis that passes the center of the bearing stand 22. In this connection, it is a matter of course that a bearing 24 is provided between the bearing stand 22 and the rotary post 20.

The seat 30 is configured, as shown in FIG. 2, such that the user M can sit down on it and is adapted to rotate together with the rotary post 20. As the seat 30 is caused to rotate with the rotary post 20, the body of the user M can swing to the left or the right.

On the other hand, the seat 30 is provided with a hollow support arm 32 integrally secured thereto, and the hollow support arm 32 has a leg support unit 40 detachably attached to the hollow support arm 32. The leg support unit 40 allows the user M to stretch and put his legs M1 on the leg support unit 40, and consists of a slide bar 42 slidably fitted to the support arm 32 and a leg rest 44 installed at the slide bar 42 for supporting the ankle M2 of the user M.

In this regard, the slide bar 42 is length-adjustable along the support arm 32 depending upon a length of the legs M1 of the user M. The length-adjusted slide bar 42 is affixed in position by a bolt 46 that fastens the support arm 32 and the slide bar 42 together.

The height of the leg rest 44 can be adjusted with respect to the slide bar 42. The reason for this is that uplifting the stretched legs M1 of the user M will help increase the exercise effect of the user by maintaining tension on the hip muscle, the thigh muscle and the calf muscle. For this purpose, a height adjustor means are installed to the slide bar 42 and the leg rest 44.

The height adjustor means comprises a vertical guide hole 42*a* formed at an end portion of the slide bar 42, a shank portion 44*a* formed at the bottom surface of the leg rest 44 for up-down movement along the vertical guide hole 42*a*, and fastener means for fastening the height adjusted leg rest 44 to the slide bar 42. The fastener means includes a plurality of fixing holes 44*b* formed at the shank portion 44*a* of the leg rest 44, a through-hole 42*b* formed at the slide bar 42 for alignment with one of the fixing holes 44*b*, and a fixing pin 44*c* fixedly inserted into the mutually aligned fixing hole 44*b* and through-hole 42*b*.

The leg rest 44, which is height-adjustable along the vertical guide hole 42*a* of the slide bar 42, can enhance the effect of exercise by way of lifting up the leg M1 of the user M. In this connection, the height adjustor means is preferably adjusted in such a manner that the legs M1 of the user M sat on the seat 30 can be lifted upwards about 5° with respect to the horizontal plane.

Referring back to FIGS. 1 and 2, the twist machine of the present invention includes an annular ring gear 50 rotatably mounted to the rotary post 20, and a handle 60 fixedly secured to the ring gear 50.

The ring gear 50 is, as shown in FIG. 1, provided with a plurality of gear teeth 52 formed along an inner periphery thereof and is rotatably installed to the rotary shaft 20 by the carrier 54. The carrier 54 includes a carrier shaft 54*a* rotatably fitted around the rotary shaft 20 and a plurality of connecting rods 54*b* for interconnecting the carrier shaft 54*a* and the ring gear 50.

The handle 60 includes a fixed frame 62 vertically affixed to the ring gear 50, a T-shaped movable frame 64 movably fitted to the fixed frame 62 in the vertical direction, a pair of first horizontal support bars 65 length-adjustably assembled to the opposite ends of the movable frame 64 in the lateral direction, a pair of second horizontal support bars 66 length-adjustably assembled to each end of the first horizontal support bar 65, and a pair of handle bars 68 fixedly installed at each end of the second horizontal support bars 66. Each of the handle bars 68 is adapted to extend laterally outwardly so that, as shown in FIG. 2, the user M sat on the seat 30 can grip the handle bars 68 with both hands.

It should be noted the height of the handle bars 68 is adjusted by the vertically movable frame 64, and the position of the height-adjusted handle bars 68 is fixed by the bolt 64*a* that fastens the movable frame 64 to the fixed frame 62. Further, the lateral position of the handle bars 68 is adjusted by the laterally movable first horizontal support bars 65, and the position of the laterally-adjusted handle bars 68 is fixed by the bolt 65*a* that fastens the movable frame 64 to the first horizontal support bars 65.

In addition, the forward or rearward position of the handle bars 68 is adjusted by the horizontal support bars 66, and the position of the forwardly or rearwardly adjusted handle bars 68 is fixed by the bolt 66*a* that fastens the first horizontal support bars 65 to the second horizontal support bars 66.

On the other hand, as the ring gear 50 is rotatably mounted to the rotary post 20 and the handle 60 is affixed to the ring gear 50, the handle 60 can be rotated about the rotary post 20. While the handle 60 is affixed to the ring gear 50 in the illustrated embodiment, it may be possible that the handle 60 is directly installed to the carrier 54 without departing from the scope of the present invention.

Referring back to FIGS. 1 and 2, the twist machine of the present invention comprises reverse rotator means for reversely rotating the rotary post 20 and the handle 60 to one another when one of the rotary post 20 and the handle 20 is caused to rotate.

The reverse rotator means is provided with a sun gear 70 affixed to the rotary post 20, a plurality of planetary gears 72 rotatably mounted to the base 10 in a meshing engagement with the sun gear 70, and a ring gear 50 fixedly secured to the handle 60 in a meshing engagement with the planetary gears 72 and having gear teeth 52 formed at an inner periphery thereof.

Figure 3:
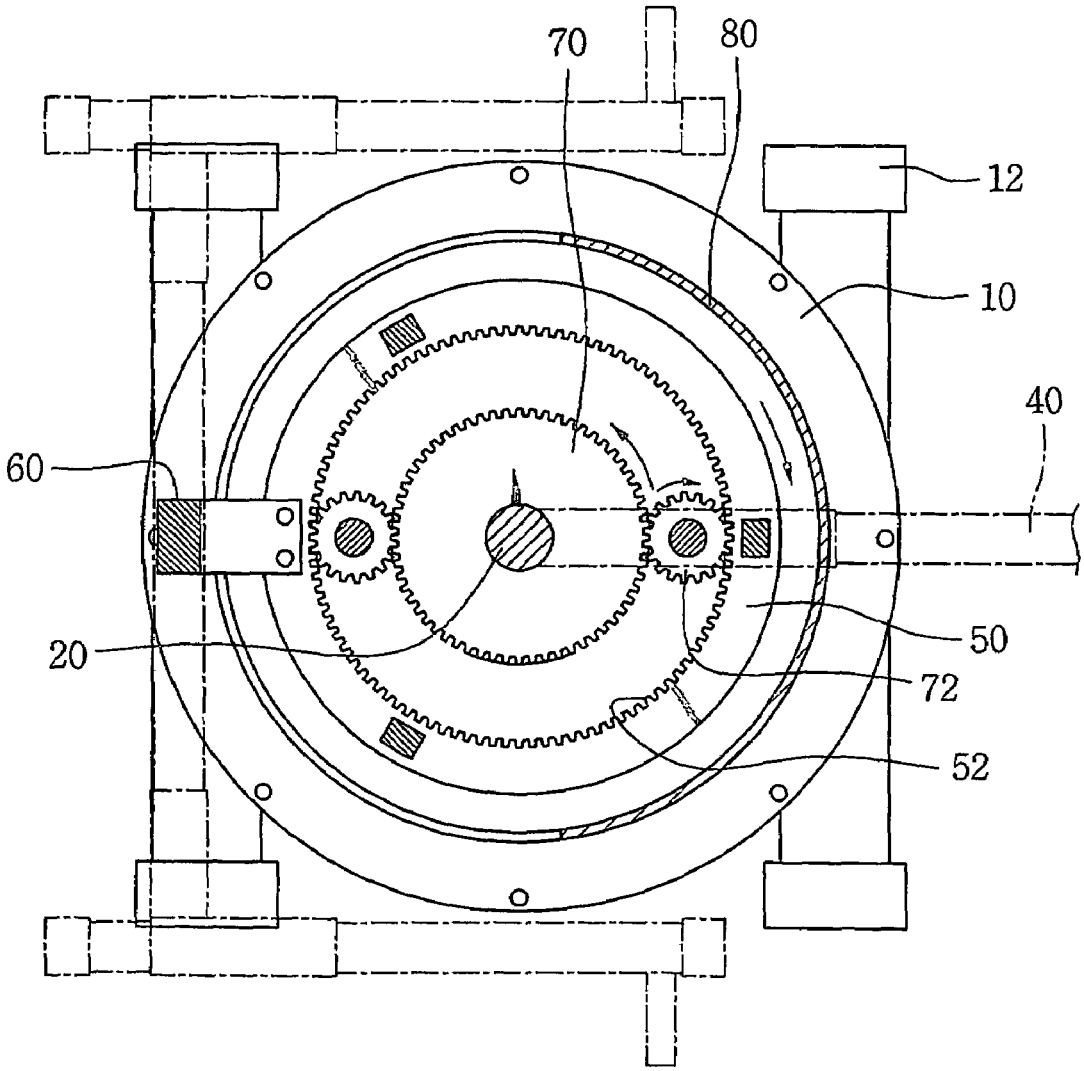
FIG. 3 is a cross-sectional view taken along line III—III in FIG. 2.

As shown in FIG. 3, the reverse rotator means is of such construction that the planetary gear 72 disposed between the sun gear 70 and the ring gear 50 can reverse the rotational force transmitted from the sun gear 70 or the ring gear 50 when one of the sun gear 70 and the ring gear 50 is rotated. Then, the reversed rotational force is transmitted to the ring gear 50 or the sun gear 70, thereby reversely rotating the sun gear 70 and the ring gear 50 with each other.

More specifically, when the ring gear 50 is rotated clockwise, the planetary gear 72 in a meshing engagement with the ring gear 50 is rotated clockwise. As the planetary gear 72 is subjected to clockwise rotation, the sun gear 70 in a meshing engagement with the planetary gear 72 is rotated counterclockwise. Therefore, the ring gear 50 and the sun gear 70 are rotated in the opposite direction with each other.

Figure 4A:
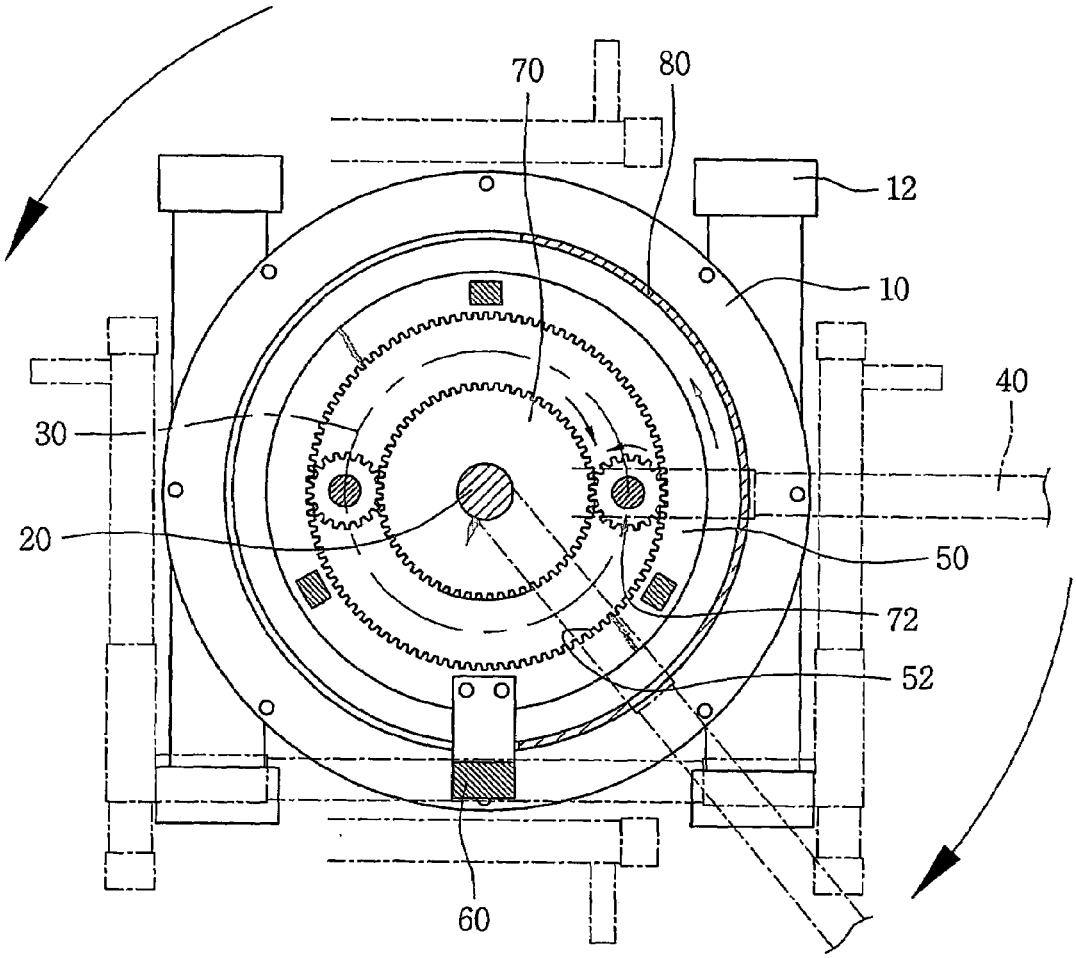
FIGS. 4*a* and 4*b* show operating conditions of the twist machine in accordance with the present invention.
Figure 4B:
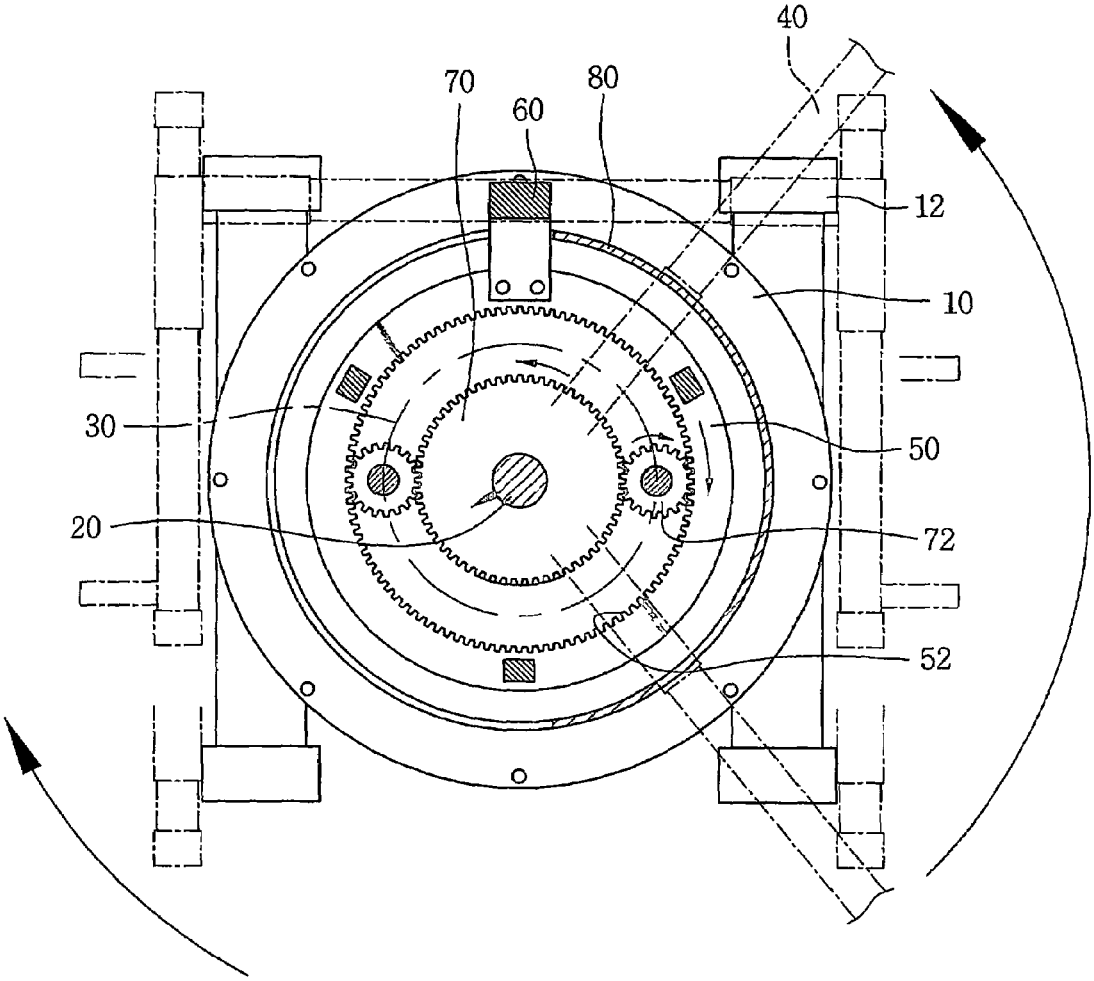

Eventually, as shown in FIGS. 4*a* and 4*b*, as the ring gear 50 and the sun gear 70 are rotated in the opposite direction, the handle 60 affixed to the ring gear 50 and the rotary post 20 secured to the sun gear 70 are rotated reversely with each other. And, as the handle 60 and the rotary post 20 are rotated in the opposite direction, the seat 30 mounted to the rotary post 20 and the handle bars 68 of the handle 60 are also rotated reversely to one another. The result is that the upper body of the user gripping the handle bars 68 and the lower body of the user sat on the seat 30 are swung reversely with each other and therefore twisted.

Referring back to FIGS. 1 and 2, the twist machine of the present invention comprises a cover 80 for surrounding the ring gear 50, the sun gear 70 and the planetary gear 72 of the reverse rotator means. The cover 80 serves to hide the ring gear 50, the sun gear 70 and the planetary gear 72 of the reverse rotator means for protecting the ring gear 50, the sun gear 70, the planetary gear 72 and various bearings 24 from contamination of foreign matters such as dusts and moisture. It should be appreciated that the cover 80 has a semi-circular slot 82 formed at its upper surface so that the fixed frame 62 of the handle 60 can pass through the slot 82.

Next, a method of using the inventive twist machine will be described in conjunction with FIGS. 2, 3, 4*a* and 4*b*.

First, as shown in FIG. 2, after the user sat on the seat 30, the user grips the handle bars 68 with both hands. Then, the user M sat on the seat 30 rotates the handle 60 to any one direction by using both hands. As a result, as shown in FIGS. 4*a* and 4*b*, rotation of the ring gear 50 connected to the handle 60 causes rotation of the planetary gear 72, thereby rotating the sun gear 70 in the reverse direction to the ring gear 70. Finally, as the sun gear 70 and the ring gear 50 are rotated reversely with each other, the seat 30 and the handle 60 are rotated reversely with each other to thereby twist the upper body and the lower body of the user M.

At this time, the leg support unit 40 affixed to the seat 30 causes the legs M1 of the user M to rotate in the same direction with the seat 30.

The twist machine of the present invention makes it possible for the user to do coincident exercise of the abdomen, the waist, the breast, the arms, the shoulder and the legs. That is, the reverse rotation of the handle 60 and the seat 30 results in the waist muscle and the abdomen muscle being used to exercise the waist and the abdomen. Especially, the reverse rotation of the handle 60 and the seat 30 applies great forces on the abdomen to effectively reduce the fat in the abdomen.

In addition, such rotation of the handle 60 entails use of the arm muscles, the breast muscle and the shoulder muscle to perform exercise of the corresponding bodily parts. Especially, the rotation of the handle 60 with both hands leads to frequent use of the shoulder muscle in a concentrated manner.

Moreover, the rotation of the seat 30 also causes the leg muscle to be used for the exercise of the user's legs. Especially, the use of the thigh muscle and the calf muscle of the legs helps get rid of the fat of the thigh and the calf.

Moreover, the twist movement noted above assists in promoting the intestine movement and loosening up the stiff neck muscle and the nervine muscle. Especially, the repeated twisting movement increases the heart pulsation to effectuate heart/lung exercise and aerobic exercise of every bodily part, thus eliminating the body fat.

On the other hand, after the leg support unit 40 is removed, the twisting movement may be performed to promote movement of the bodily joints such as the knee and the ankle. Especially, the twisting movement allows the femoral muscle to be used, thus effectively loosening up the femoral muscle.

INDUSTRIAL APPLICABILITY OF THE INVENTION

As described in detail above, the twist machine for whole body exercise in accordance with the present invention has an advantage of evenly exercising every parts of the human body such as the abdomen, the waist, the breast, the arms and the legs by twisting the upper body and the lower body of the user. Coincidental execution of non-aerobic and aerobic exercise provides the effect of strengthening the user's muscles and reducing the bodily fat.

The invention claimed is:

1. A twist machine for whole body exercise comprises:

a base;

a rotary post rotatably mounted on the base;

a seat, adapted for a user to sit upon, provided on a top portion of the rotary post;

a handle operatively associated with the rotary post for rotation about the rotary post; and a reverse rotator for causing the rotary post and the handle to turn in opposite directions relative to each other when one of the rotary post or the handle is subjected to a rotational force, wherein the reverse rotator is provided with a sun gear affixed to the rotary post, a plurality of planetary gears rotatably mounted to the base in meshing engagement with the sun gear; and a ring gear fixedly secured to the handle in meshing engagement with the planetary gears.

2. The twist machine as recited in claim 1, further comprising a leg support unit affixed to the seat for supporting legs of a user sitting on the seat.

3. The twist machine as recited in claim 2, wherein the leg support unit includes a slide bar length-adjustably assembled to the seat and a leg rest installed at the slide bar to support a user's ankles.

4. The twist machine as recited in claim 1, wherein the handle includes a fixed frame vertically affixed to the ring gear, a movable frame length-adjustably assembled to the fixed frame in a vertical direction, a pair of first horizontal support bars length-adjustably assembled to opposite ends of the movable frame in a lateral direction, a pair of second horizontal support bars length-adjustably assembled to each end of the first horizontal support bar, and a pair of handle bars fixedly secured to each end of the second horizontal support bars so that the user can grip the handle bars.

* * * * *